US005657908A

United States Patent [19]

Graver

[11] Patent Number: 5,657,908

[45] Date of Patent: Aug. 19, 1997

[54] AEROSOL FLUID DISPENSER

[75] Inventor: John W. Graver, Mt. Laurel, N.J.

[73] Assignee: Scott Specialty Gases, Inc., Plumsteadville, Pa.

[21] Appl. No.: 556,441

[22] Filed: Nov. 9, 1995

[51] Int. Cl.[6] ..... B67D 5/06

[52] U.S. Cl. ..... 222/182; 222/183; 222/402.13; 222/402.14; 239/541

[58] Field of Search ..... 222/181.1, 182, 222/183, 402.13, 402.14, 518; 239/541, 579

[56] References Cited

U.S. PATENT DOCUMENTS

| | | | |
|---|---|---|---|
| 3,347,423 | 10/1967 | Rahn et al. | 222/183 |
| 3,414,171 | 12/1968 | Grisham et al. | 222/402.1 |
| 3,768,696 | 10/1973 | Laerdal | 222/183 X |
| 3,955,716 | 5/1976 | Goncalves | 222/182 X |
| 4,186,853 | 2/1980 | White | 222/182 |
| 4,350,299 | 9/1982 | Stephenson et al. | 222/402.14 X |
| 4,722,461 | 2/1988 | Symmank | 222/181.1 |
| 4,792,062 | 12/1988 | Goncalves | 222/135 |
| 5,070,858 | 12/1991 | Wang | 126/38 |
| 5,110,231 | 5/1992 | Monteith et al. | 222/402.14 X |

*Primary Examiner*—Joseph Kaufman
*Attorney, Agent, or Firm*—Dykema Gossett PLLC

[57] ABSTRACT

An apparatus for dispensing an aerosol container's pressurized fluid contents includes a base; a first, outer sleeve mounted on the base; a second, inner sleeve nested within the outer sleeve and defining a bore adapted to receive the container; and a plurality of retainers pivotally mounted to the base within the outer sleeve so as to move from a radially inward position to a radially outward position relative to the centerline of the two sleeves. The inner sleeve is biased away from the base by a first spring, such that a first internal camming surface on the inner sleeve engages each retainer to urge it radially inwardly into engagement with the container's external curl upon advancement of the container into the nested sleeves, thereby securing the container proximate to the base. Upon moving the inner sleeve towards the base, the sleeve's first internal camming surface disengages the retainers to permit their radial expansion and, hence, the release of the container's external curl. Further relative movement of the inner sleeve permits a second internal camming surface on the inner sleeve to engage a radial extension of each retainer thereby to further urge each retainer free and clear of the container's external curl. An annular valve-actuating piston, slidably mounted within a tubular guide projecting from the base in alignment with the centerlines of the two sleeves, is biased away from the base and into engagement with the container's integral valve by a second spring interposed between the piston and the base. A length of flexible tubing is attached to the piston to receive the contents of the container released by the piston.

12 Claims, 3 Drawing Sheets

AEROSOL FLUID DISPENSER

BACKGROUND OF THE INVENTION

The present invention relates to apparatus for dispensing the pressurized fluid contents of an aerosol container, wherein the apparatus removably accepts and fixedly secures the aerosol container within a housing while further engaging the container's normally-closed integral valve thereby to release its contents into and through a length of supply tubing.

The prior art teaches dispensing heads for aerosol containers wherein an actuator is mounted atop the head of the container as through interference fit between an annular element and an internal or external curl formed on the head of the container proximate to its valve cup. Once mounted atop the container, the actuator is resiliently translated toward's the container's valve cup so as to actuate the container's recessed dispensing valve, thereby controllably releasing the pressurized fluid contents of the container in direct relation to the manner and duration of such actuator translation. See, e.g., U.S. Pat. Nos. 3,347,423 to Rahn et al; 4,792,062 to Goncalves; and 3,414,171 to Grisham et al. In this manner, the actuator works in concert with the container's integral valve to meter out the container's pressurized fluid contents upon demand. The dispensing head may include a spray nozzle or, depending upon the desired application, a length of supply tubing through which the dispensed fluid may otherwise be directed upon actuation of the container's integral valve.

In the event that continuous actuation of the container's integral valve is desired to provide a constant stream of effluent from the container, the prior art teaches a dispensing head having a fixed actuator which fully actuates the container's integral valve immediately upon securing the dispensing head onto the valve cup of the container cylinder head. See, e.g., U.S. Pat. No. 4,186,853 to White, wherein the dispensing head is secured to the container through interference fit of the dispenser's annular housing with an external curl formed proximate to the container's valve cup; and U.S. Pat. No. 5,070,858 to Wang, wherein a gas container is secured to a portable stove using a pair of spring-loaded claws which pivotally engage opposite sides of the container's external curl. Unfortunately, these fixed-actuator dispensers inherently rely upon the resiliency of the container's integral valve to ensure a proper seal between the actuator and the complementary portions of the valve with which the actuator engages, and to otherwise fully actuate (open) the valve upon securing together the dispenser and container.

What is needed, therefor, is an apparatus for dispensing the pressurized fluid contents of a container, wherein the container may be removably inserted and secured relative to the dispenser, whereupon the container's normally-closed integral valve is fully opened to release its fluid contents through a length of supply tubing while a proper seal is otherwise maintained between container and dispenser.

SUMMARY OF THE INVENTION

In accordance with the present invention, an apparatus for dispensing the pressurized fluid contents of a container, the head of which includes both an external lip or curl and an integral dispensing valve, includes a base; a first, outer sleeve mounted to the base; a second, inner sleeve nested within the outer sleeve, the inner surface of which defines a generally cylindrical bore adapted to receive the head of the container and to otherwise align the container with respect to a first axis; and a spring disposed between the base and one end of the inner sleeve to resiliently bias the inner sleeve away from the base. The dispensing apparatus further includes a latch means, such as a plurality of radially-pivoting retainers, mounted on the base for retaining the external curl on the container proximate to the base once the container is advanced into the nested sleeves and down towards the base. A internal flange on the inner sleeve defines a first radially inner camming surface which is otherwise urged into engagement with a radially outer camming surface on each retainer by the action of the first spring, which camming surfaces thereby cooperate to urge each retainer radially inwardly into engagement with the container's external curl as the latter nears the base.

In accordance with the present invention, the dispensing apparatus further includes a tubular guide projecting from the base along the first axis, the mouth of which preferably engages the head of the container to further align the container with the first axis as it nears the dispenser base. A valve-actuating piston movable within the tubular guide is itself resiliently biased away from the base and, hence, towards the mouth of the tubular guide by a second spring. The piston includes a passage extending from a valve-actuating hollow nipple (or valve-actuating recess in the event that the dispenser valve integral to the container includes a male valve stem projecting from the valve cup) on one longitudinal end through to a counterbored region in the piston's other end. The counterbored region is itself sized to receive a length of flexible supply tubing through which the released contents of the container will pass upon installation of the container within the dispenser.

In accordance with another feature of the present invention, the inner sleeve is provided with a second radially inner camming surface which engages a radial extension of each retainer upon sufficient movement of the inner sleeve towards the base (such movement being resisted by the first spring) to urge each retainer radially outwardly. Thus, upon axial displacement of the inner sleeve relative to the outer sleeve, the inner sleeve's first camming surface will disengage from the camming surface of each retainer, whereupon the retainers are free to pivot radially-outwardly to release the container. Further relative axial displacement of the inner sleeve will cause the inner sleeve's second camming surface to engage each retainer thereby to pivot each retainer free and clear of the container's external curl. In a preferred embodiment, the inner sleeve projects out from one end of the outer sleeve and, most preferably, is provided with an external flange on its projecting end to facilitate such downward displacement of the inner sleeve relative to the outer sleeve.

DETAILED DESCRIPTION OF THE PREFERRED EMBODIMENT

Figure 1:
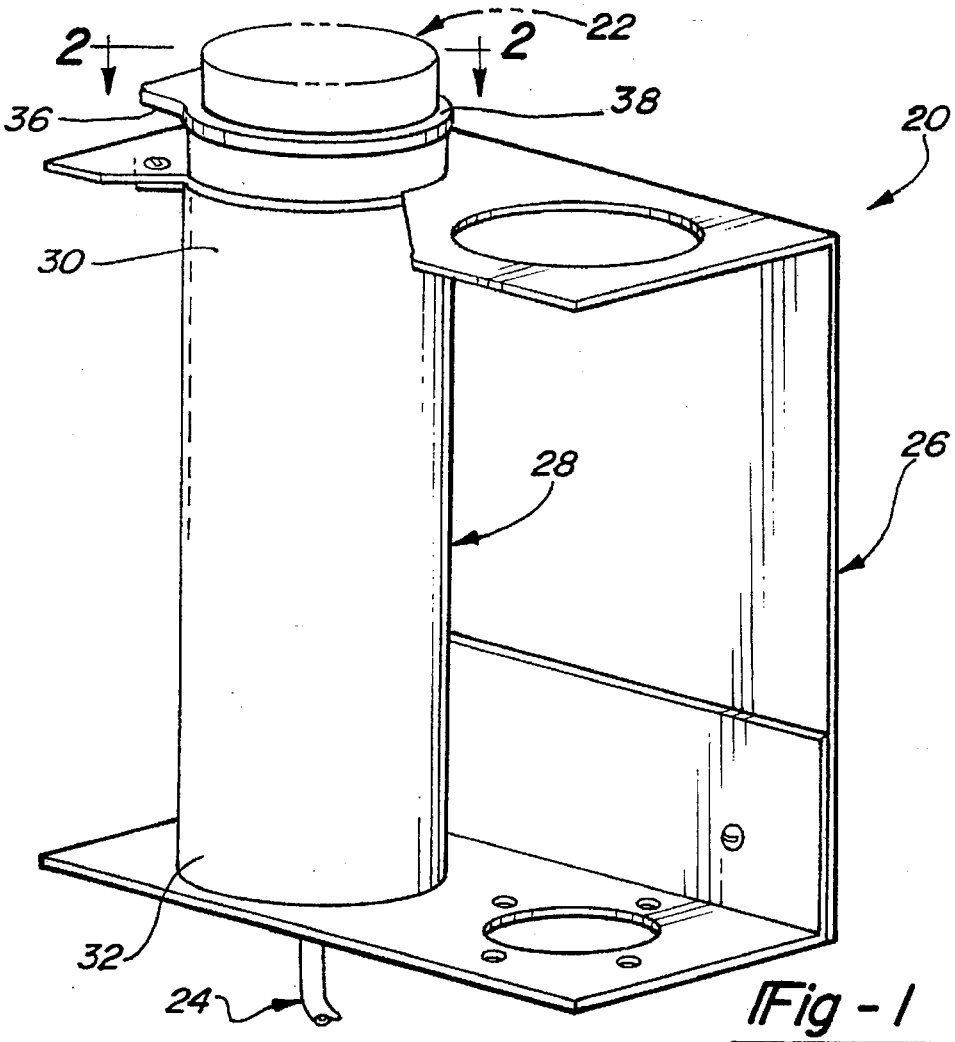
FIG. 1 is a prospective view, partially broken away, of an exemplary aerosol fluid dispenser in accordance with the present invention.

An exemplary dispenser 20 constructed in accordance with the present invention for dispensing the pressurized fluid contents of an aerosol container 22 through a length of flexible supply tubing 24 is shown in FIG. 1. The dispenser 20 includes a frame 26, a first, outer sleeve 28 secured to the frame 26 at its upper and lower ends 30, 32, and an second, inner sleeve 34 nested within the outer sleeve 28 so as to remain substantially coaxial with, but axially displaceable with respect to, the outer sleeve 28. In accordance with the present invention, the inner sleeve 34 is provided with an external flange 36 extending from its upper end 38 to permit an operator to displace the inner sleeve 34 downwardly relative to the outer sleeve 28 in the manner to be described below.

Figure 2:
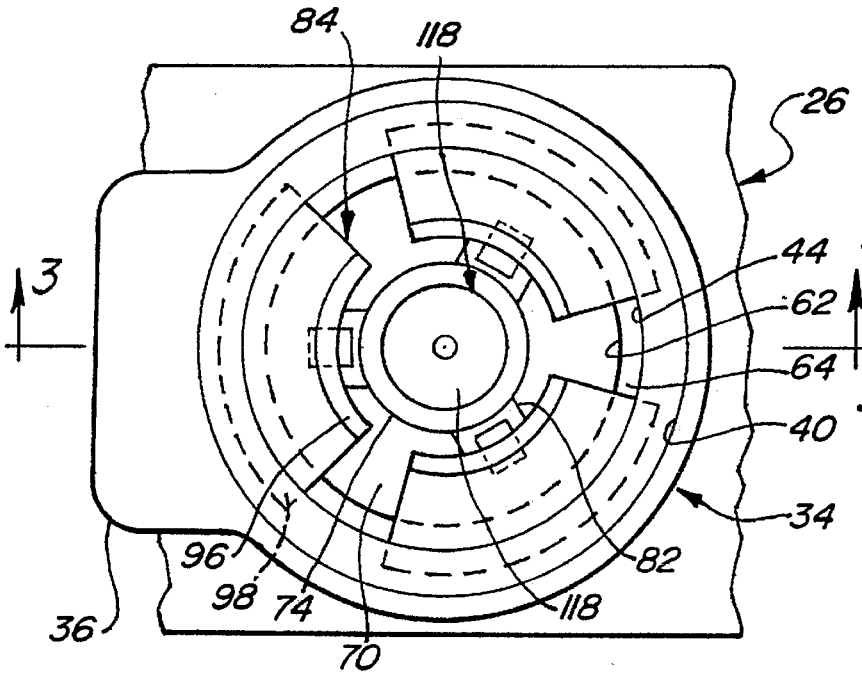
FIG. 2 is a top view of the dispenser of FIG. 1 along line 2—2 thereof.
Figure 4:
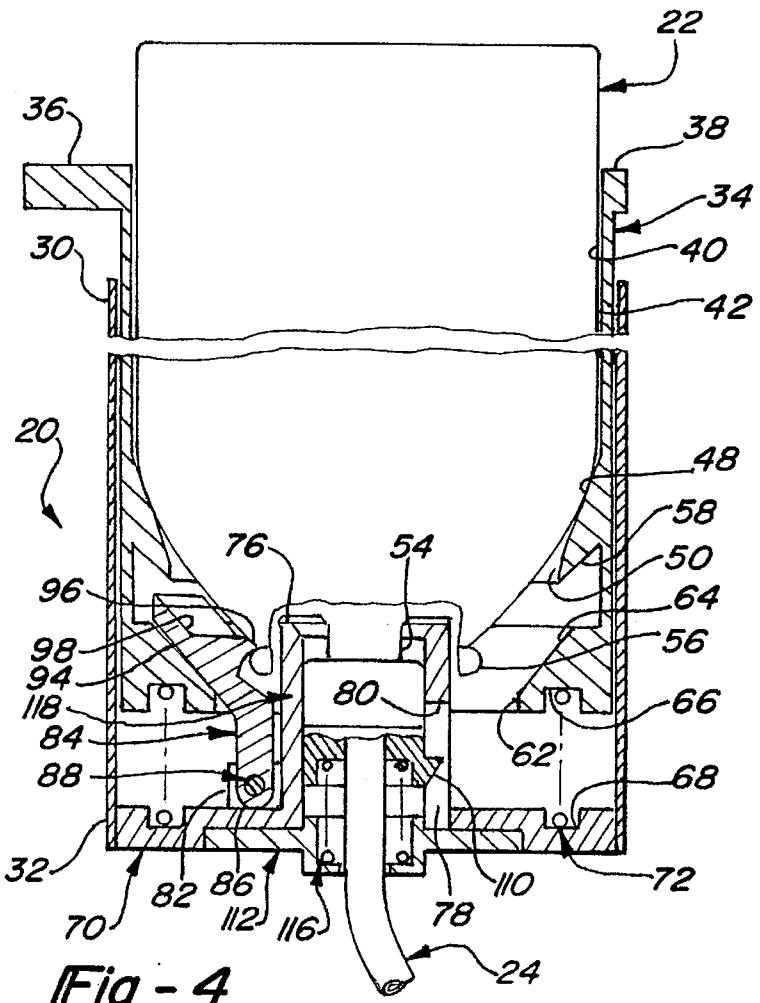
FIG. 4 is a sectional view of the dispenser similar to that of FIG. 3 upon installation of the aerosol can therein.
Figure 3:
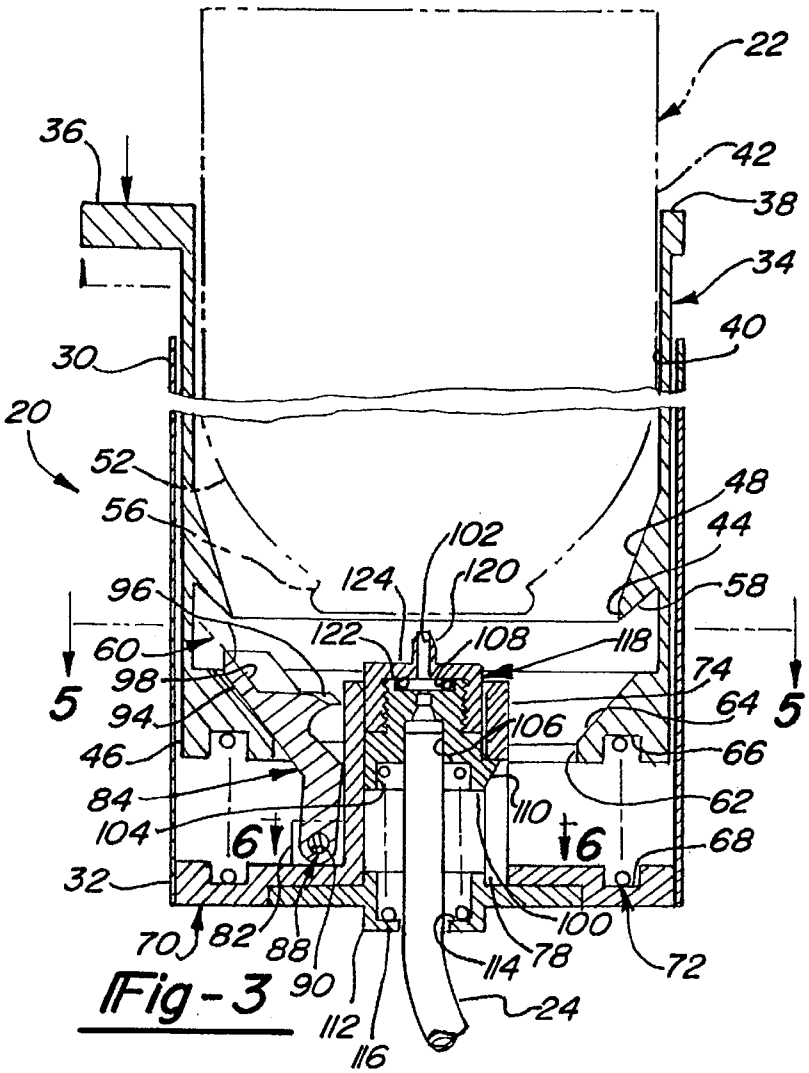
FIG. 3 is a sectional view of the dispenser along line 3—3 of FIG. 2 prior to insertion of an aerosol container with an integral female dispensing valve therein.
Figure 5:
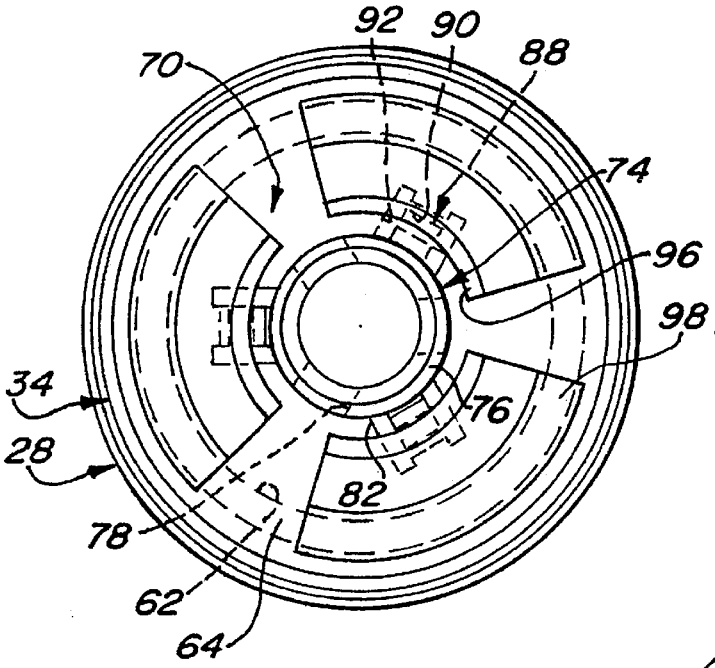
FIG. 5 is a sectional view of the dispenser along line 5—5 of FIG. 3.
Figure 6:
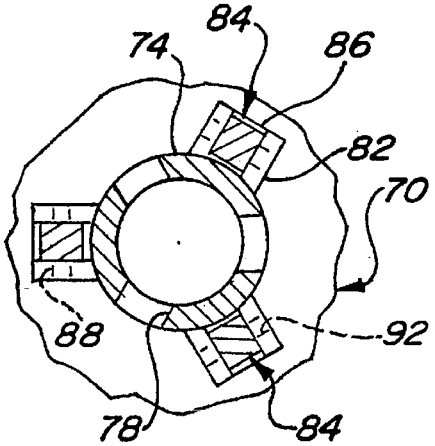
FIG. 6 is a sectional view of the dispenser along line 6—6 of FIG. 3 with the spring, spring retainer and supply tubing removed for clarity.

Referring to FIGS. 2–4, the inner surface of the inner sleeve 34 defines a generally cylindrical bore 40 which is adapted to receive the generally cylindrical body 42 of the aerosol container 22. In addition, the inner surface of the inner sleeve 34 includes a internal flange 44 intermediate the sleeve's first and second ends 38,46. One side 48 of the intermediate flange 44 defines a frustoconical surface which is complimentary to the head of the aerosol container 22, thereby defining an annulus 50 through which the container's valve cup 52 (with its recessed, female, normally-closed dispenser valve 54) and its external curl 56 passes upon insertion of the aerosol container 22 down into the inner sleeve 34.

The other side 58 of the inner sleeve's intermediate flange 44 is canted back so as to define an annular recess 60 beneath the flange 44. A second internal flange 62 on the inner sleeve 34 defines the sleeve's annular base. This second, lower flange 62 includes a frustoconical camming surface 64, the utility of which will be described more fully below. The underside of the lower flange 62 includes an annular recess 66. The annular recess 66 on the lower flange 62 cooperates with an opposed annular recess 68 formed in the outer sleeve's base 70 to provide opposed seating surfaces for a helical spring 72. The spring 72 serves to bias the inner sleeve 34 and, hence, the camming surface 64 on the sleeve's lower flange 62 away from the outer sleeve's base 70.

Referring to FIGS. 3–6, the base 70 of the outer sleeve 28 further includes a central, longitudinally-extending tubular projection 74, the mouth 76 of which is dimensioned so as to fit within the external curl 56 of the aerosol container 22 when the latter is fully seated within the dispenser 20. The mouth 76 of the tubular projection 74 is preferably provided with an internal chamfer to facilitate the passage of the container's recessed dispenser valve 54 thereinto. The mouth 76 of the tubular projection 74 preferably further serves to align the valve cup 54 of the container 22 with the inner and outer sleeves 34,28.

In addition, the outer sleeve base 70 is provided with three slots 78 extending longitudinally from the underside of the sleeve base 70 up into tubular projection 74. Each slot 78 terminates in the tubular projection 74 so as to define an axially-disposed bearing surface 80 thereon, the purpose of which will be described further below. The outer sleeve base 70 is further provided with three pairs of longitudinally-extending flanges 82 disposed about the periphery of tubular projection 74. Each of three retainers 84 is mounted at one end 86 to its respective pair of longitudinal flanges 82 on the outer sleeve base 70 by means of a pivot pin 88 which passes through complimentary apertures 90,92 formed in the first end 86 of each retainer 84 and each flange 82, respectively.

The free end 94 of each retainer 84 includes a arcuate inner flange 96 which is adapted to engage the external curl 56 of the inserted aerosol container 22 as each retainer 84 is urged radially inwardly by camming surface 64 on the inner sleeve's second inner flange 62. Each retainer 84 further includes an arcuate outer flange 98 which extends into the annular recess 60 underlying the inner sleeve's intermediate flange 44 and which is urged radially outwardly upon its engagement with the underside 58 of intermediate flange 44 in the event of sufficient downward displacement of the inner sleeve 34 (such sufficient downward displacement being shown in phantom in FIG. 3).

As seen in FIGS. 3 and 4, the present dispenser 20 further includes an annular piston base 100 disposed within the tubular projection 74 of the outer sleeve base 70. The piston base 100 is provided with a longitudinal aperture 102 extending from a lower counterbore 104 through an intermediate counterbore 106 to an upper counterbore 108, the purpose of each of which will be described below. The piston base 100 further includes three radially-outwardly-extending barbs 110 which slide within the longitudinal slots 78 of tubular projection 74 and otherwise cooperate with bearing surfaces 80 of each slot 78 to limit upward travel of the piston base 100 relative to the outer sleeve base 70.

An annular spring retainer 112 mounted to the outer sleeve base 70 beneath tubular projection 74 provides an annular recess 114 in opposition with the piston base's lower counterbore 104. A second helical spring 116 is located within the tubular projection 74 so as to be seated in the annular recess 114 of the spring retainer 112 and the lower counterbore 104 of the piston base 100, respectively. In this manner, spring 116 acts to urge piston base 100 towards the mouth 76 of the tubular projection 74.

Meanwhile, the flexible supply tubing 24 passes through a central aperture formed in the spring retainer 112, up through the center of the piston base spring 116, and into the piston base's intermediate counterbore 106, wherein it is suitably attached as by a threaded pressure fitting (not shown).

An annular piston cap 118 is placed atop the piston base 100 and secured thereto as by mating threaded surfaces. The piston cap 118 has a centralized hollow nipple 120 extending from its upper surface which is sized to engage the recessed dispensing valve 54 of the aerosol container 22 when the latter is inserted into the dispenser 20. The underside of the piston cap 118 is provided with an annular recess 122 which opposes the upper counterbore 108 of the piston base 100. An O-ring seal 124 or other suitable sealing means is disposed between the opposed counterbores 122,108 of the piston cap 118 and piston base 100 to effect a seal therebetween.

In operation, prior to insertion of the aerosol container 22 into the cylindrical bore 40 defined by the dispenser's inner sleeve 34, the inner sleeve 34 is itself biased upwardly relative to the outer sleeve 28 by spring 72 such that the camming surface 64 on the inner sleeve's lower flange 62 engages each retainer 84 to radially inwardly bias its first arcuate flange 96. Meanwhile, piston biasing spring 116 likewise urges the piston base 100 and piston cap 118 away from the outer sleeve's base 70 until the barbs 110 on the piston base 100 engage the complimentary bearing surfaces 80 in each of the base's longitudinal slot 78.

Upon insertion and advancement of an aerosol container 22 into the cylindrical bore 40 defined by the dispenser's inner sleeve 34, the external curl 56 of the aerosol container 22 passes through the annulus 50 defined by the inner sleeve's flange 44 to ultimately bear against the ramped upper edges of each retainer's inner flange 96, whereupon each retainer 84 will pivot radially outwardly to permit the passage of the container's external curl 56 therethrough. Meanwhile, such downward displacement of the aerosol container 22 will cause the aerosol container's recessed dispenser valve 54 to sealingly engage the hollow nipple 120 on the upper side of the piston cap 118, whereafter the piston cap 118 and piston base 100 will both be displaced downwardly into the outer sleeve base's tubular projection 74, as resisted by piston biasing spring 116. In this manner, the dispenser 20 ensures that a proper seal will be achieved between the valve-actuating piston 100 and the container's recessed dispenser valve 54.

Once the external curl 56 of the aerosol container 22 has passed beneath the first arcuate flange 96 of each retainer 84, inner sleeve biasing spring 72 will cooperate with camming surface 64 to urge the free end 94 of each retainer 84 radially inwardly to thereby secure the head of the aerosol container 22 within the dispenser 20. Meanwhile, piston biasing spring 116 will continue to urge piston base 100 and piston cap 118 away from base 70 and, hence, up towards the valve cup 54, thereby ensuring not only that the nipple 120 is maintained within recessed dispenser valve 54, but also that the nipple 120 will fully actuate (opened) the valve 54.

To remove the aerosol container 22 from the dispenser 20, the inner sleeve 34 is displaced in a downward direction relative to the outer sleeve 28 as by pushing downward on the inner sleeve's external flange 36, whereupon camming surface 64 is disengaged from each retainer 84. In this manner, the free end 94 of each retainer 84 is free to pivot away from the container's external curl 56 and, hence, to release the container 22 from within the dispenser 20. To the extent that the shape of inner flange 96 and the container's external curl 56 cooperate so as to maintain the container 22 proximate to the base 70 of the dispenser 20 notwithstanding disengagement of camming surface 64 and each retainer 84, under the present invention, additional downward displacement of the inner sleeve 34 relative to the outer sleeve 28 will cause the underside 58 of the inner sleeve's intermediate flange 44 to engage the second arcuate flange 98 of each retainer 84 thereby to urge each retainer's free end 94 radially outwardly and release the external curl 56 of the aerosol container 22.

And, with retainers 84 pivoted away from the container's external curl 56, piston biasing spring 116 will urge piston base 100, piston cap 118 and, hence, the valve cup 52 of the aerosol container 22, away from outer sleeve base 70, thereby urging the external curl 56 of aerosol container 22 upward past the inner flange 96 of each retainer 84. The resiliency of the sealing means incorporated within the container's recessed dispenser valve 54 may also assist the container's upward motion, given its likely tendency to expel the hollow nipple 120 of the piston cap 118 upon upward motion of the container 22. In this manner, the container 22 is released and may subsequently be removed from the inner sleeve 34 of the dispenser 20.

From the foregoing, it will be appreciated that the aerosol container 22 may be removed from the dispenser 20 in the manner described above when its pressurized fluid contents has only partially been released. Thus, the present invention may be used to release only a portion of the contents of a given aerosol container 22, whereupon the container 22 may be removed from the dispenser 20 for storage and later use.

Figure 7:
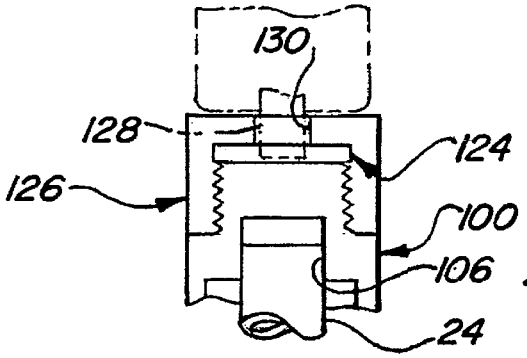
FIG. 7 is a cross-sectional view of an alternative cap threadably secured atop the piston base for use with aerosol containers having integral male dispensing valves.

Referring to FIG. 7, an alternate piston cap 126 is shown for use with the exemplary dispenser 20 described above in the event that the aerosol container 22 is provided with a "male" dispenser valve, i.e., one wherein a male valve stem 128 projects from the valve cup. Specifically, in contrast with the hollow nipple 120 formed on the upper side of the first piston cap 118, the alternate piston cap 126 is provided with a widened central bore 130 in which to receive valve stem 128 (the dispenser valve itself being actuated upon engagement of valve stem 128 with counterbore 108 of piston base 100). In this alternate embodiment, the O-ring seal 124 may be sized so that it may radially engage the outer surface of the valve stem 128 to effect a better seal between valve and the piston cap 126.

From the foregoing, it will be appreciated that the retainers 84 operate in concert with camming surface 64 on the inner sleeve 34 (as biased away from the base 70 of the outer sleeve 28 by spring 72) to securely retain the external curl 56 of the container 22 within the dispenser 20 while the valve-actuating piston 100 is resiliently biased towards and, hence, sealingly engaged with the container's valve cup 54 by its own spring 116. As such, the dispenser 20 may be operated over a wide temperature range, in that the springs 72 and 112 accomodate thermal expansion of either container or dispenser. Likewise, the dispenser 20 may advantageously be operated in any position and, for example, in reduced/"zero" gravity applications. In accordance with another feature of the present invention, the mass of the inner sleeve 34 and, particularly, the spring rate of spring 72 are selected to ensure that the container 22 will not resonate within the dispenser 20 over a desired operating frequency range.

While the preferred embodiment of the invention has been disclosed, it should be appreciated that the invention is susceptible of modification without departing from the spirit of the invention or the scope of the subjoined claims. Thus, for example, while the preferred embodiment employs a camming surface on the underside 58 of the inner sleeve's intermediate flange 44 to urge each retainer 84 radially outwardly and, hence, disengage each retainer 84 from the external curl 56 of container 22, it will be appreciated that the present invention contemplates elimination of the intermediate flange 44 in favor of other means, such as axially- or radially-extending control rods, with which each retainer may be controllably pivioted radially outwardly so as to disengage the retainer's arcuate inner flange 96 from the container's external curl 56. Similarly, the present invention contemplates use of means other than camming surface 64 of the inner sleeve's lower flange 62 with which to urge each retainer 84 radially inwardly into engagement with the container's external curl 56.

I claim:

1. An apparatus for dispensing a pressurized fluid contained within a container, wherein the container has an external curl and a dispensing valve, said apparatus comprising:

a base;

a first sleeve mounted to the base;

an annular element movable within said first sleeve along a first axis, said annular element defining a generally cylindrical bore adapted to receive the container and align the container with respect to said first axis;

a latch means mounted on said base for retaining the external curl on the container proximate to the base once the container is advanced into said annular element and along said first axis towards said base; and valve-actuating means mounted on said base in opposition to the dispensing valve of the container when the external curl of the container is retained by said latch means, said valve-actuating means including a tubular guide mounted on said base, an annular piston movable within the tubular guide along said first axis, and a first spring means for resiliently biasing the piston toward a first position within the tubular guide, wherein the piston engages the dispensing valve of the container when the piston is in the first position, and wherein the piston is displaced within the tubular guide from the first position by the dispensing valve of the container when the latch means engages the external curl on the container.

2. The apparatus of claim 1, wherein said latch means includes a plurality of retainers, each retainer being pivotally mounted to said base so as to pivot from a first radially inward position to a second radially outward position, each retainer including an arcuate flange engageable with the external curl of the container when each retainer pivots to the first position.

3. The apparatus of claim 1, including a second spring means disposed between said base and said annular element to resiliently bias said annular element away from said base; and wherein said annular element includes a first radially inner camming surface engageable with a first radially outer camming surface on the latch means to urge said latch means into engagement with the external curl of the container as said annular element is resiliently biased away from said base.

4. The apparatus of claim 1, wherein said annular element includes a second radially inner camming surface engageable with a second radially outer camming surface on the latch means to urge said latch means out of engagement with the external curl of the container upon displacement of the annular element within said sleeve towards said base.

5. The apparatus of claim 1, wherein said annular element extends from an end of said sleeve.

6. An apparatus for dispensing a pressurized fluid contained within a container, wherein the container has an external curl and a dispensing valve proximate to the external curl, said apparatus comprising:

a base;

latch means on said base for releasably engaging the external curl on the container to secure the container relative to said base;

valve-actuating means mounted on said base in opposition to the dispensing valve of the container when the container is secured relative to said base by said latch means, said valve-actuating means including a tubular guide mounted on said base, an annular piston movable within the tubular guide, and a first spring means for resiliently biasing the piston toward a first position within the tubular guide, wherein the piston engages the dispensing valve of the container when the piston is in the first position, and wherein the piston is displaced within the tubular guide from the first position by the dispensing valve of the container when the latch means engages the external curl on the container.

7. The apparatus of claim 6, wherein said latch means includes a plurality of retainers, each retainer being pivotally mounted to said base so as to pivot from a first radially inward position to a second radially outward position, each retainer including an arcuate flange engageable with the external curl of the container when each retainer pivots to the first position.

8. The apparatus of claim 7, wherein each retainer further includes a first radially outer camming surface; and wherein said apparatus further includes:

an annular element encircling said retainers, said annular element having a first radially inner camming surface engageable with the first camming surface of each retainer; and a second spring means disposed between said base and said annular element for resiliently biasing the camming surface of said annular element into engagement with the first camming surface of each retainer, whereby said retainers are urged towards the first position.

9. The apparatus of claim 8, further including a sleeve mounted to said base in concentricity with the tubular projection of said valve-actuating means, said sleeve encompassing said annular element.

10. The apparatus of claim 9, wherein said annular element extends from an end of said sleeve.

11. The apparatus of claim 8, wherein said annular element extends away from said base to define a bore adapted to receive and align the container relative to said retainers of said latching means and the tubular projection of said valve-actuating means.

12. The apparatus of claim 8, wherein said annular element includes a second radially inner camming surface, and each retainer includes a second radially outer camming surface; and wherein the second camming surface on said annular element engages the second outer camming surface on each retainer upon movement of said annular element towards said base, whereby each retainer is pivoted radially outwardly to the second position.

* * * * *